US007490961B2

(12) United States Patent
Chung

(10) Patent No.: US 7,490,961 B2
(45) Date of Patent: Feb. 17, 2009

(54) SYSTEM OF, AND METHOD FOR, INDIRECT LIGHTING

(75) Inventor: Casey Chung, Bloomingdale, IL (US)

(73) Assignee: Focal Point, LLC, Chicago, IL (US)

( * ) Notice: Subject to any disclaimer, the term of this patent is extended or adjusted under 35 U.S.C. 154(b) by 0 days.

(21) Appl. No.: 10/781,539

(22) Filed: Feb. 17, 2004

(65) Prior Publication Data

US 2005/0180132 A1 Aug. 18, 2005

(51) Int. Cl.
*F21V 11/06* (2006.01)

(52) U.S. Cl. ..... 362/292; 362/342; 362/354; 362/360

(58) Field of Classification Search ..... 362/217, 362/291–292, 354, 360, 290, 342, 343
See application file for complete search history.

(56) References Cited

U.S. PATENT DOCUMENTS

| | | | | |
|---|---|---|---|---|
| 1,217,420 | A | 2/1917 | Davis et al. | |
| 2,429,141 | A * | 10/1947 | Taylor | 362/217 |
| 3,628,007 | A | 12/1971 | Gunnar et al. | |
| 4,388,675 | A | 6/1983 | Lewin | |
| 4,390,930 | A | 6/1983 | Herst et al. | |
| 4,418,378 | A | 11/1983 | Johnson | |
| 4,516,197 | A * | 5/1985 | Yonkers | 362/342 |
| 4,833,575 | A * | 5/1989 | Hamilton | 362/223 |
| 4,884,178 | A | 11/1989 | Roberts | |
| 4,974,137 | A | 11/1990 | Evans, Jr. et al. | |
| 5,097,401 | A | 3/1992 | Eppler | |
| 5,105,345 | A | 4/1992 | Katoh et al. | |
| 5,278,738 | A | 1/1994 | Illes | |
| 5,570,525 | A | 11/1996 | Paglieri et al. | |
| 5,709,460 | A | 1/1998 | Lester | |
| 5,733,028 | A | 3/1998 | Ramer et al. | |
| 5,743,627 | A * | 4/1998 | Casteel | 362/222 |
| D397,819 | S | 9/1998 | Thornton, Jr. | |
| 5,914,487 | A | 6/1999 | Ramer et al. | |
| 5,967,648 | A | 10/1999 | Barnes, II et al. | |
| 5,967,652 | A | 10/1999 | Ramer et al. | |
| 5,988,836 | A | 11/1999 | Swarens | |
| 6,043,873 | A | 3/2000 | Ramer et al. | |
| 6,064,061 | A | 5/2000 | Ramer et al. | |
| 6,088,091 | A | 7/2000 | Ramer et al. | |
| 6,231,212 | B1 * | 5/2001 | Cooney et al. | 362/290 |
| 6,238,077 | B1 | 5/2001 | Ramer et al. | |
| 6,250,772 | B1 * | 6/2001 | Entrop et al. | 362/225 |

(Continued)

FOREIGN PATENT DOCUMENTS

| | | |
|---|---|---|
| JP | 03-190004 | 8/1991 |

OTHER PUBLICATIONS

Renaissance Lighting Wall Washer CMH Series Specifications.

(Continued)

*Primary Examiner*—Thomas M Sember
(74) *Attorney, Agent, or Firm*—Banner & Witcoff, Ltd.

(57) ABSTRACT

A light fixture is configured to provide indirect lighting from a light source through use of a light shield. The light shield blocks a percentage of the light emitted from the light source at a center of the light shield. The light shield decreasing blocks light emitted from the light source along a path between the center and an outer edge of the light shield.

22 Claims, 8 Drawing Sheets

U.S. PATENT DOCUMENTS

| | | | | |
|---|---|---|---|---|
| 6,266,136 | B1 | 7/2001 | Ramer et al. | |
| 6,305,824 | B1 * | 10/2001 | Holten | 362/290 |
| 6,334,700 | B2 | 1/2002 | Ramer et al. | |
| 6,416,201 | B1 | 7/2002 | Strand et al. | |
| 6,561,678 | B2 | 5/2003 | Loughrey | |
| 2002/0172046 | A1 | 11/2002 | Perlo et al. | |

OTHER PUBLICATIONS

LAM Performance Indirect, HPD Specifications.
Alera Lighting IPR Low Profile Indirect Parabolic Reflector Specifications 2-1C.
Finelite, Inc., Finelite Series 14—Technical Sheet.
Alera Lighting Technical Installatin Data IPRL 2-1.1 C.
Alera Lighting Indirect IPR Indirect Parabolic Reflector 2-2 C.

* cited by examiner

SYSTEM OF, AND METHOD FOR, INDIRECT LIGHTING

BACKGROUND OF THE INVENTION

1. Field of the Invention

The present invention relates to lighting, specifically to an indirect lighting fixture.

2. Description of Related Art

While different types of electrical light sources exist, one major type of electrical light source is a linear source, such as a tubular fluorescent lamp. Typically, such a lamp is mounted overhead and provides direct light to illuminate an area. As direct light can produce a glare and be relatively harsh, the emitted light can be modified through diffusion or refraction to lessen the glare and harshness. An alternative method of illuminating an area with a linear source is to direct some of the light upward from a position below the ceiling so as to provide illumination from the reflection of the light off the ceiling. Such indirect lighting fixtures tend to provide a more even and natural looking illumination without the harsh glare of direct lighting.

A problem with indirect lighting fixtures is that such fixtures often produce localized areas of brightness and observable shadows on the ceiling and thus do not provide a relatively uniform light distribution pattern. One solution to minimizing the areas of brightness and the casting of shadows is to suspend the indirect light fixture farther from the ceiling. The increase in distance softens the change in light intensity, thus making patterns of brightness and shadows on the ceiling less noticeable. However, such fixtures may not be preferred for installation in low ceiling applications where the distance of suspension from the ceiling can create clearance problems for adults and may otherwise create an undesirable appearance.

In an attempt to provide a fixture suitable for a low ceiling application, some light fixtures use reflectors, often with complex geometry, to shape the light distribution. While sometimes providing acceptable results, often such light fixtures require a substantial thickness in the light fixture to shape the light into an acceptable light distribution. The increase in size of the light fixture tends to increase both the weight and expense of the fixture while also making it less suitable for low ceiling applications.

BRIEF SUMMARY OF THE INVENTION

One aspect of the present invention is a compact, low profile indirect light fixture with a light shield that is suitable for installation on a ceiling and can be used in low ceiling applications. In an embodiment, the light shield has a plurality of coverage zones with a varying light blocking area. In an embodiment, a percentage of the light can pass through the light shield of the coverage zone closest to the center of the light shield and an increasing percentage of light can pass through a subsequent coverage zone located near the outer edge of the shield. In an embodiment, the resultant light distribution provides a pleasing pattern on the reflective surface without distracting shadows or bands of light. In an embodiment, the light passing through the shield increases between a perpendicular angle and an offset angle corresponding to the angle of the main beam. In an embodiment, the light passing through the shield at the perpendicular angle is some percentage less then the light passing through the shield at the offset angle corresponding to the angle of the main beam.

BRIEF DESCRIPTION OF THE DRAWINGS

The present invention is illustrated by way of example and not limited in the accompanying figures in which like reference numerals indicate similar elements and in which.

DETAILED DESCRIPTION OF THE INVENTION

Figure 1:
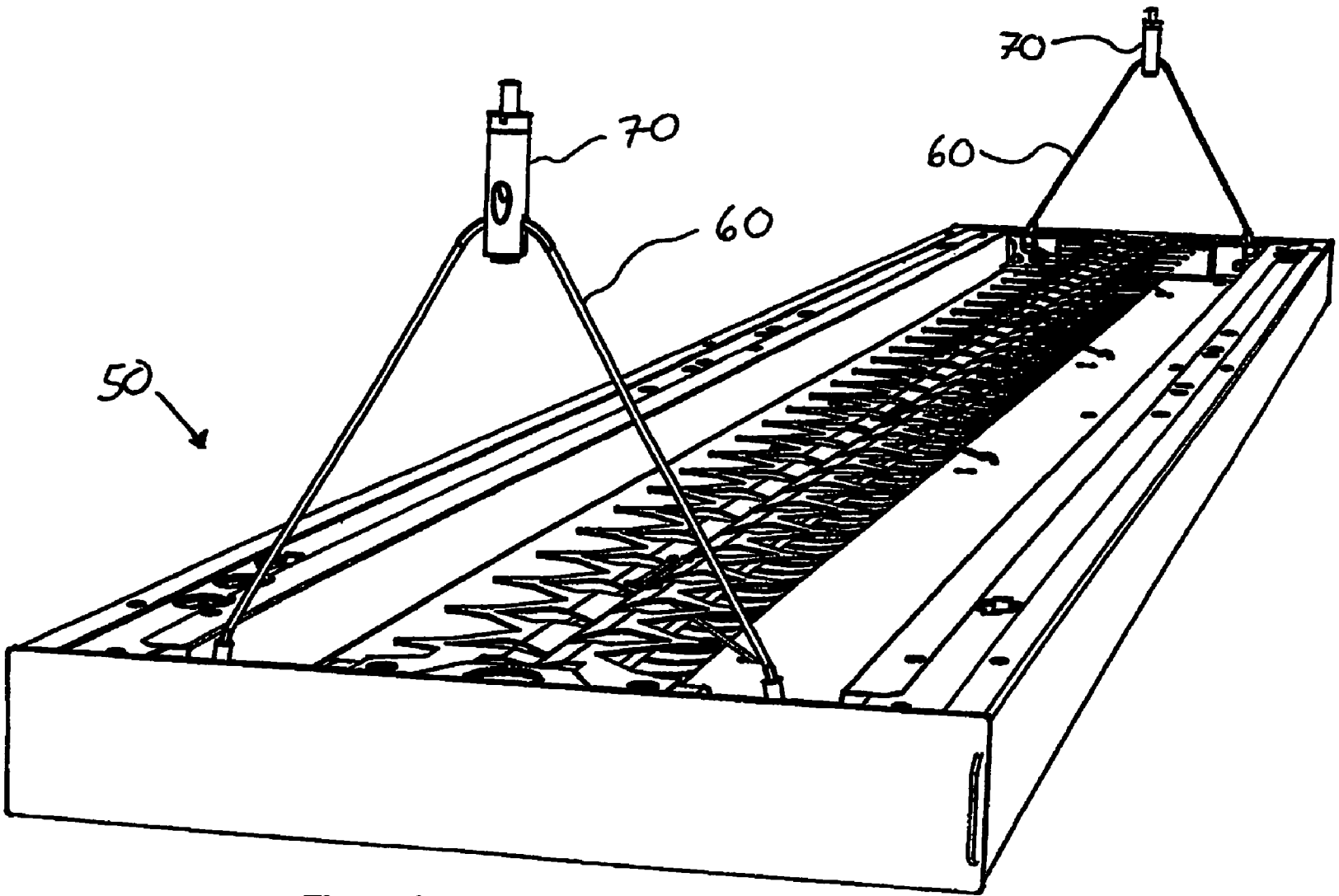
FIG. 1 illustrates a perspective view of an embodiment of a light fixture of the present invention.

The general concept of a light fixture is known in the art. Generally, a light fixture is adapted to receive electrical power and is configured to accept a light source and power the light source when power to the fixture is turned on. Thus, when installed and turned on, the light fixture operates to activate a light source so as to provide illumination. FIG. 1 depicts a perspective view of an exemplary embodiment of a light fixture representative of the present invention. As depicted, a light fixture 50 is supported by a hanger 60 that is mounted to a bracket 70. Thus, the light fixture 50 is mounted to some upper surface such as a ceiling, not shown, that can have a certain reflective property. Preferably, the light fixture is about 12 inches from the reflective surface. Light emitted from the light fixture 50 can be used to illuminate a room where the light fixture 50 is installed. As can be readily appreciated and as would be known to those of skill in the art, numerous other methods for supporting the light fixture 50 are possible, thus the depicted method is illustrative.

Figure 2:
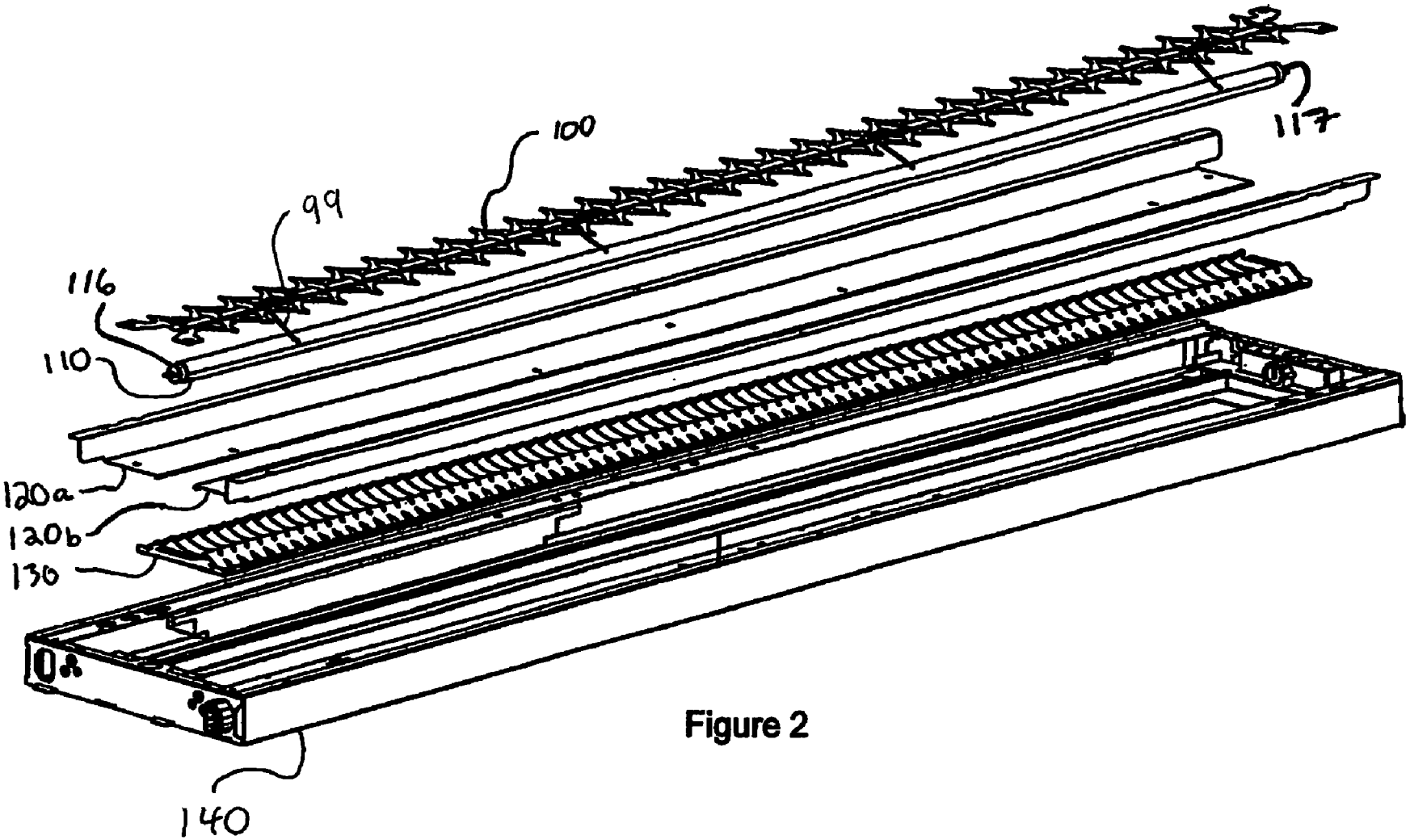
FIG. 2 illustrates a simplified exploded view of the embodiment depicted in FIG. 1.

FIG. 2 depicts an exploded view of the embodiment depicted in FIG. 1. The light fixture 50 comprises a light housing 140. As depicted, the light housing 140 supports the components of the light fixture 50 and can provide an attractive profile useful in ensuring aesthetic values of the room are maintained when the light fixture 50 is installed.

As depicted in FIG. 2, a light dispersion shield 130 is mounted to the light housing 140. The light dispersion shield 130 can allow light to radiate down through the light housing 140. Mounted to the light housing 140 beside the light dispersion shield 130 is a light reflector 120*a* and a light reflector 120*b*. As depicted, the light reflector 120*a* and light reflector 120*b* are mounted to the light housing 140 to provide symmetrical reflection of the light. A light source 110 is mounted to the light housing 140 above the light dispersion shield 130. In an embodiment, the light source 110 is a standard fluorescent light. The light source 110 has a first end 116 and a second end 117. A light shield 100 is mounted to the light housing 140 above light source 110. The light shield 100 can be fashion of any suitable material such as steel, aluminum or various alloys or plastic. Preferably the shield material is strong enough to minimize deflection of the light shield 100 when installed.

Figure 3A:
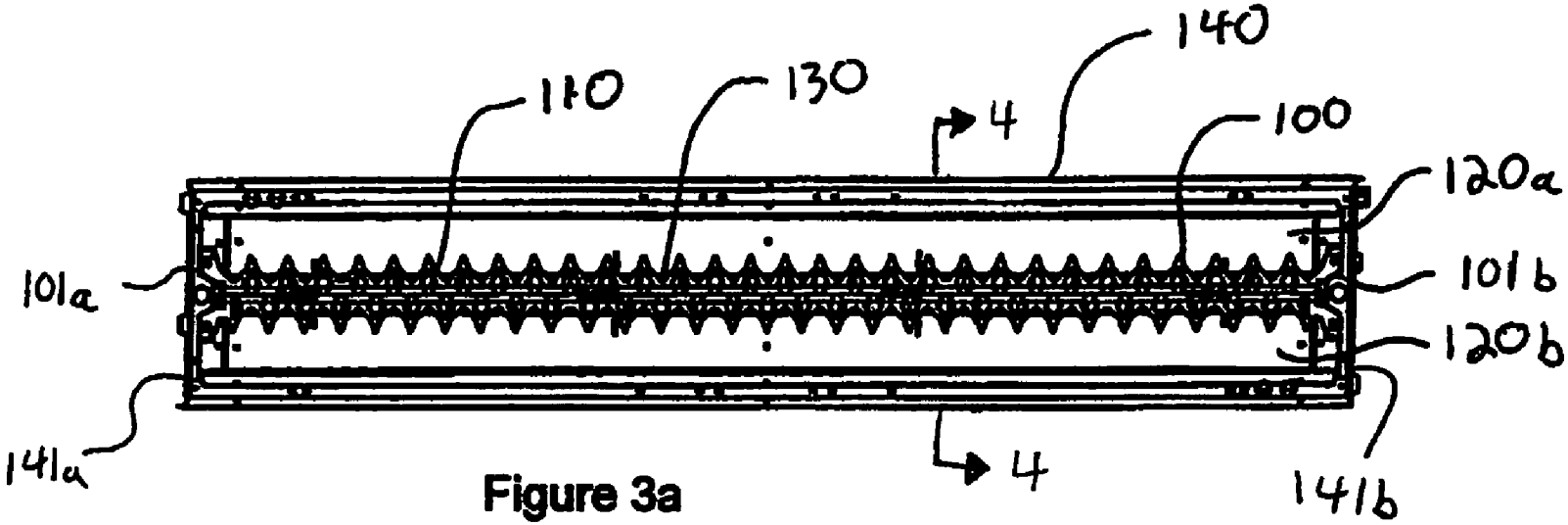
FIG. 3*a* illustrates a plan view of embodiment pictured in FIG. 1.

FIG. 3*a* depicts a plan view of the embodiment depicted in FIG. 2. As depicted, the light shield 100 covers a portion of the light source 110, and also covers a portion of the light reflector 120 and the light dispersion shield 130. Thus, as depicted, a center of the light shield 100 is configured to rest directly above a centerline of the light source 110. As depicted, the light source 110 extends most of the internal length of the light housing 140 and the light shield 100 extends beyond the first end 116 and second end 117 of the light source 110.

Figure 3B:
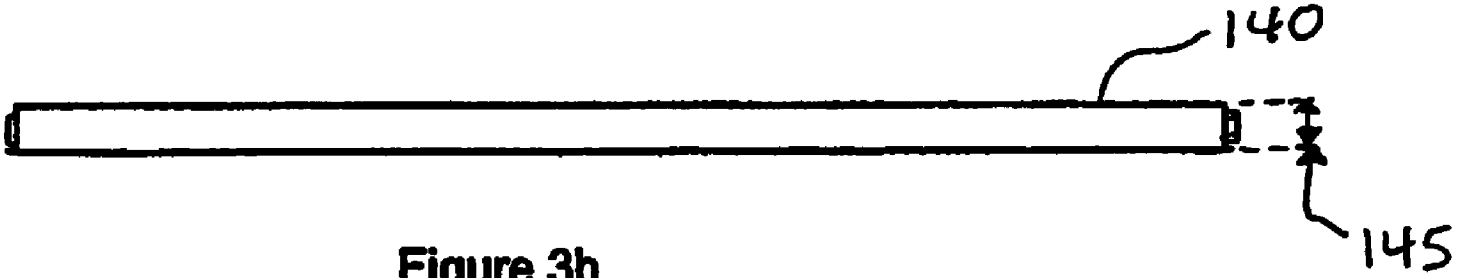
FIG. 3*b* illustrates a front view of the embodiment pictured in FIG. 3*a*.

FIG. 3*b* illustrates a front view of the embodiment depicted in FIG. 3*a*. As can be readily appreciated, light housing 140 has a thickness 145, as shown by the arrow. Reducing the thickness 145 of light housing 140 reduces the weight and the cost of light fixture 50. In addition, a decreased thickness 145 allows for installation of the light fixture in locations where the ceiling is relatively low, for example having a height of less then 10 feet. Thus, a decreased thickness 145 is valuable for making the light fixture 50 more presentable to individuals seeking a light fixture capable of providing indirect lighting.

Figure 4A:
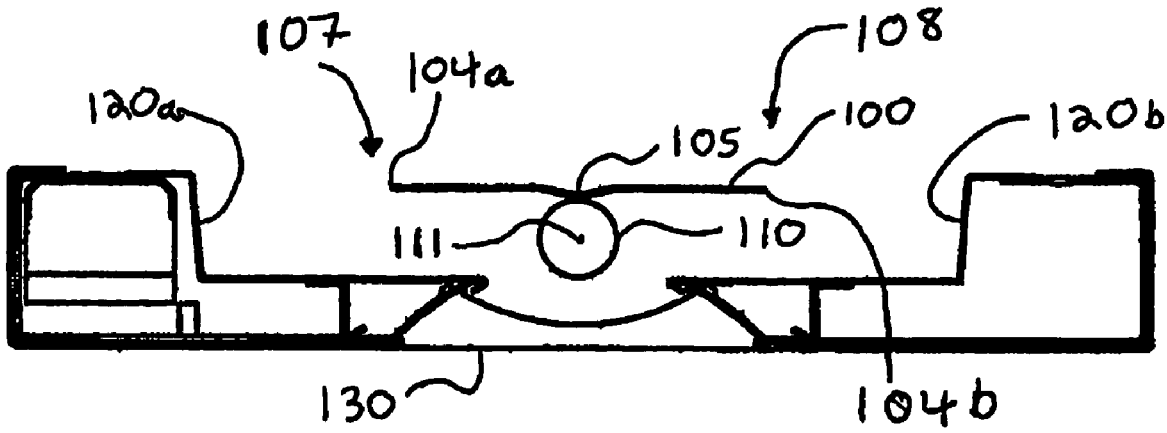
FIG. 4*a* illustrates a cross-sectional view of the embodiment depicted in FIG. 3*a*, along the lines of 4-4.

FIG. 4*a* is a cross-sectional view of the embodiment depicted in FIG. 3*a* along the lines 4-4. The cross-sectional view of FIG. 4*a* also illustrates the intersection of a vertical plane with the light fixture 50. Light source 110 has a light center 111, shown as a point in FIG. 4*a*, that extends along the longitudinal length of the light source 110 between the first end 116 and the second end 117. Thus, the vertical plane is transverse to the light center 111 extending the length of the light source 110. As depicted in FIG. 4*a*, the light shield 100 has a shield center 105 and a first outer edge 104*a* and a second outer edge 104*b*. The light shield 100 can be further defined to have a first side 107, depicted as being located to the left of the shield center 105 and a second side 108, depicted as being located to the right of the shield center 105.

As depicted in FIG. 4*a*, the light shield 100 blocks a portion of the light emitted from the light source. The percentage of light blocked by the light shield 100 is greatest at the shield center 105 and decreases towards the outer edge 104*a* and outer edge 104*b*. Preferably, the change in the percentage of light being blocked is linear so as to minimize shadows or sudden changes in brightness on the reflecting surface. In an exemplary embodiment, the percentage of light blocked at the shield center 105 is 70 percent and this percentage decreases linearly to 0 percent at the outer edges of the light shield 100.

Figure 4B:
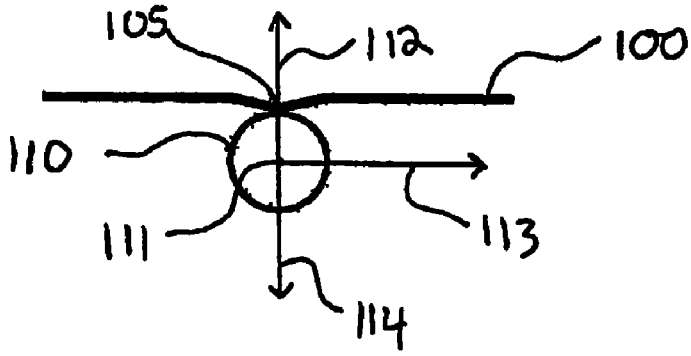
FIG. 4*b* is a simplified cross sectional view of the light source and shield as depicted in FIG. 4*a*.

FIG. 4*b* is a simplified view of FIG. 4*a*. Using the light center 111 as a reference, light source 110 has a 180 degree axis 112 extending straight up, a 90 degree axis 113 extending to the right, and a 0 degree axis 114 extending straight down. Thus, the shield center 105 is directly over the light center 111 (i.e. the shield center 105 is on the 180 degree axis). A horizontal plane can be defined as containing a line extending along the light center 111 and also containing a line extending from the light center 111 along the 90 degree axis 113.

Figure 5:
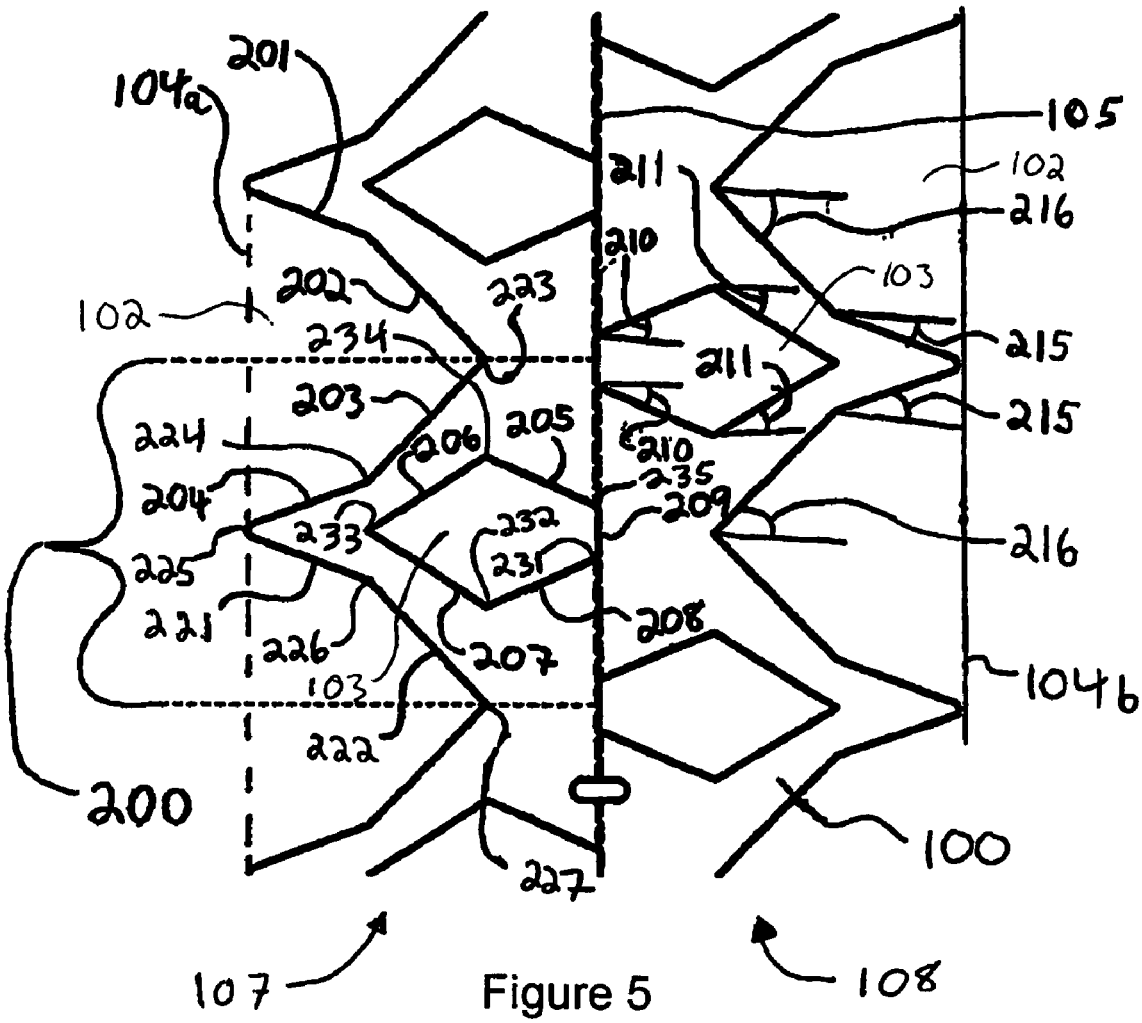
FIG. 5 illustrates a partial plan view of an embodiment of a light shield.

FIG. 5 depicts a partial plan view of the light shield 100. An inner aperture 103 is defined by an edge 205 at an angle 210, an edge 206 at an angle 211, an edge 207 at an angle 211, an edge 208 at an angle 210 and an edge 209 along the shield center 105. As depicted, an outer aperture 102 is defined as an edge 201 at an angle 216, an edge 202 at an angle 216, an edge 203 at an angle 216, an edge 204 at an angle 215 and the outer edge 104*a*. Both the inner aperture 103 and the outer aperture 102 are found on the first side 107 and the second side 108. As numerous other angles and shapes are possible, the depicted geometry is illustrative. For example, a curve with a varying slope could be used to define the inner aperture.

The light shield 100, as depicted in FIG. 5, has a saw-tooth like pattern. In an exemplary embodiment, the saw-tooth like pattern can be defined by a section 200 that repeats itself. The outer boundary of section 200 is defined by the edge 203, the edge 204, the edge 201 and the edge 202. As depicted, an inner boundary of the section 200 is defined by the edge 205, the edge 206, the edge 207, the edge 208 and the shield center 105.

As previously discussed, the light shield 100 has the first side 107, and the second side 108 and a length configured to correspond to the length of the light housing 140 and the light source 110. In an embodiment, the lengthwise position of each section 200 on a first side 107 of the light shield 100 is not symmetric about the shield center 105 with the lengthwise position of any section 200 along a second side 108 of the light shield 100. In an embodiment, every section 200 on the first side 107 is offset as compared to every section 200 of the second side 108. This offsetting of the location of the section 200 on the first side 107 versus the location of the section 200 on the second side 108 can provide for improved structural rigidity of the light shield 100.

Figure 6:
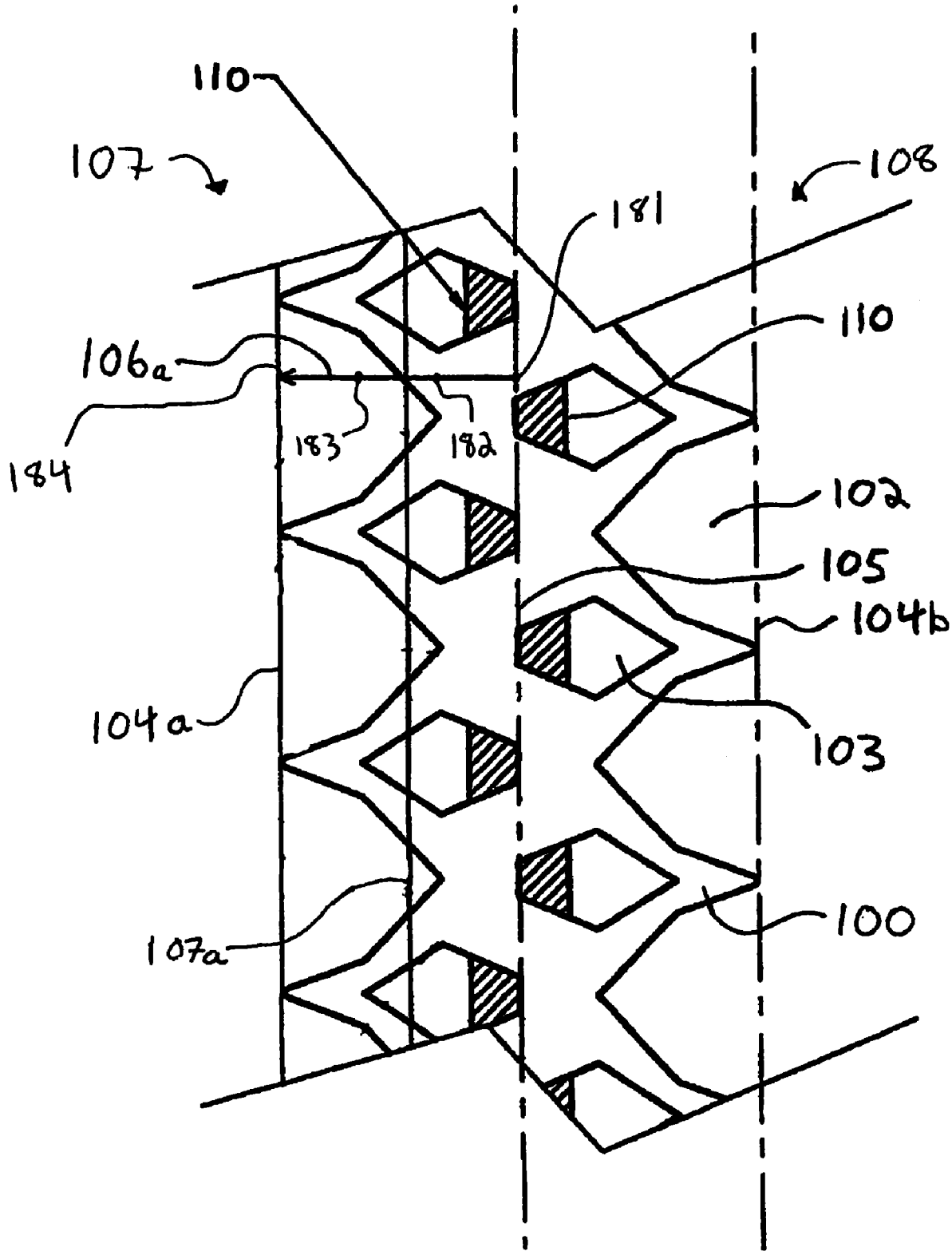
FIG. 6 illustrates a partial simplified plan view of an embodiment of a light shield and visible portions of a light source depicted in FIG. 1.

As depicted in FIG. 6, the inner aperture 103 and the outer aperture 102 are configured to allow light from the light source 110 to pass through the light shield 100. The inner aperture 103 has an initial non-blocking area at the shield center 105. The path 106*a*, shown by the arrow, has a first point 181 at the shield center 105, a second point 182 some distance along the path, a third point 183 at a position between the second point and the outer edge 104, and a fourth point 184 on the outer edge 104. As depicted, the non-blocking area of the inner aperture 103 increases at a linear rate along the path 106 between the first point 181 and the second point 182. The inner aperture 103 then decreases at a linear rate along the path 106 between the second point 182 and third point 183. The outer aperture 102 has a non-blocking area that increases at a first linear rate along the path 106 between the second point 182 and third point 183. The outer aperture 102 then increases at a second linear rate along the path 106 between the third point 183 and the fourth point 184. In an embodiment, the combined change in non-blocking area of both the inner aperture 103 and the outer aperture 102 provides a linear increase of the non-blocking area from the shield center 105 to the outer edge 104. In an embodiment, the light blocking area of the light shield 100 decrease along the path 106*a* from the shield center 105 to the outer edge 104*a*.

Figure 7:
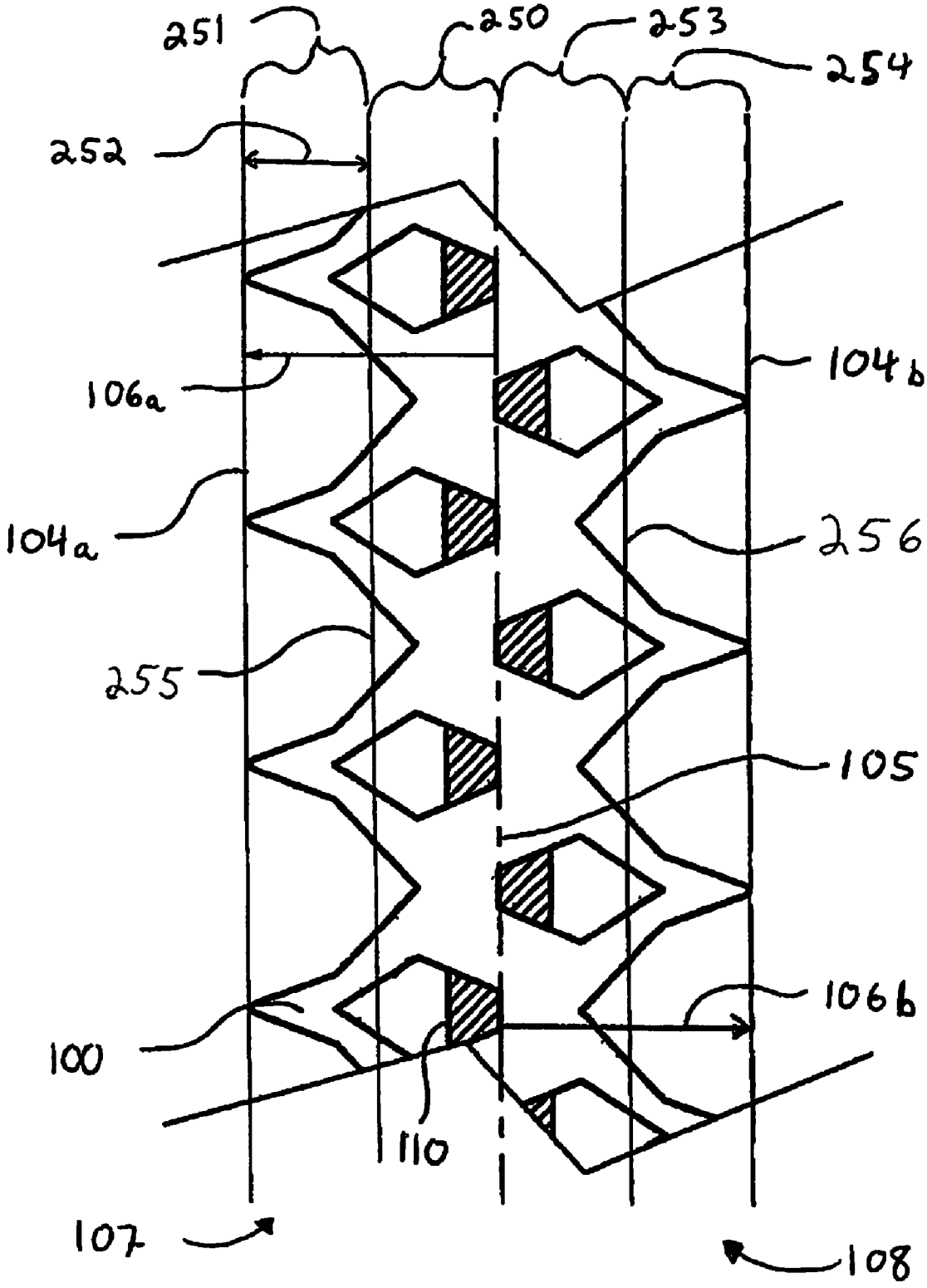
FIG. 7 illustrates a partial simplified plan view of an embodiment of the light shield and the light source.

FIG. 7 depicts a simplified partial plan view of the light shield 100 and the light source 110. The first path 106*a* can be defined as running from the shield center 105 to the outer edge 104*a*, the path 106*a* being parallel to the 90 degree axis 113. Along the path 106*a* a plurality of coverage zones can be defined.

As depicted in FIG. 7, a coverage zone 250 and a coverage zone 251 are shown on the first side 107. Coverage zone 250 is defined as extending the length of the shield 100 between the shield center 105 and a boundary line 255. Coverage zone 251 is defined as the area extending the length of the shield 100 between the boundary line 255 and the outer edge 104*a*. A coverage zone 253 and a coverage zone 254 are shown on the second side 108. The coverage zone 253 is defined as the area extending the length of the light shield between the shield center 105 and the zone boundary 256. The coverage zone 254 is defined as the area extending the length of the light shield 100 between the zone boundary 254 and the outer edge 104*b*.

As depicted, the coverage zone 250, the coverage zone 251, the coverage zone 253 and the coverage zone 254 have the same width 252. The light blocking area can be defined as the percentage of area of the shield 100 in the coverage zone that blocks light. Preferably, the measurement of the percentage of area that blocks light is take in a plan view as depicted in FIG. 7. Along the path 106*a*, the light blocking area of the coverage zone 250 is greater then the light blocking area of the coverage zone 251. Along the path 106*b*, the light blocking area of the coverage zone 253 is greater then the light blocking area of the coverage zone 254.

Figure 8:
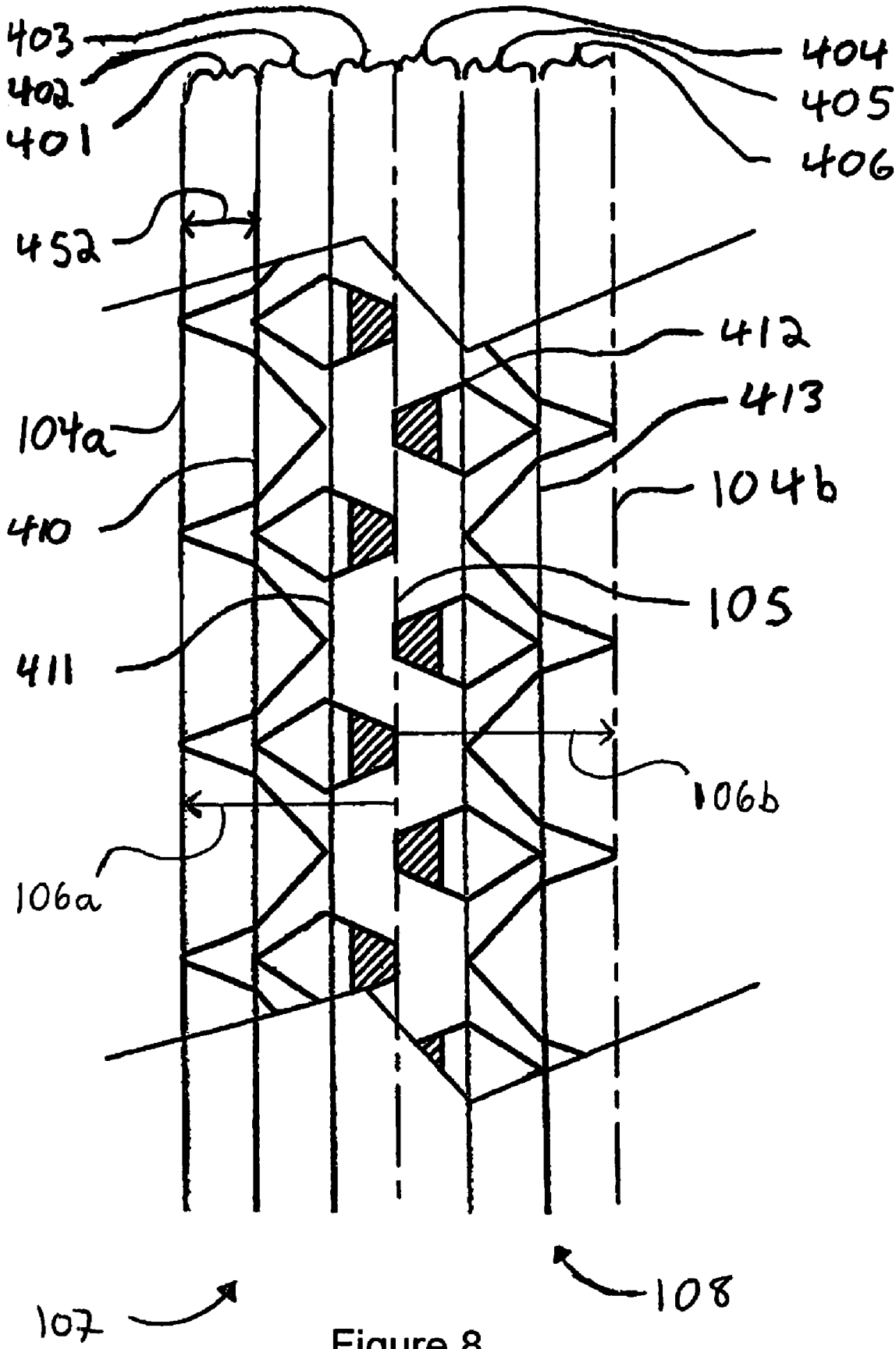
FIG. 8 illustrates an alternative embodiment of the light shield and light source depicted in FIG. 7.

In an exemplary embodiment, as depicted in FIG. 8, three coverage zones 401, 402, and 403 are defined on the first side 107. Three coverage zones 404, 405, and 406 are defined on the second side 108. The coverage zone 401 is defined as the area extending along the length of the shield 100 between the outer edge 104*a* and a zone boundary line 410. The coverage zone 402 is defined as the area extending the length of the shield 100 between the zone boundary 410 and a zone boundary 411. The coverage zone 403 is defined as the area extending the length of the light shield 100 between the zone boundary 411 and the shield center 105. The coverage zone 404 is defined as the area extending the length of the shield 100 between shield center 105 and a zone boundary 412. The coverage zone 405 is defined as the area extending the length of the shield between the zone boundary 412 and a zone boundary 413. The coverage zone 406 is defined as the area extending the length of the shield between the zone boundary 413 and the outer edge 104*b*.

As depicted, the six coverage zones 401, 402, 403, 404, 405, and 406 have the same width 452. The light blocking area of the coverage zone 403 is greater then the light block area of the coverage zone 402. The light blocking area of the coverage zone 402 is greater then the light blocking area of coverage zone 401. Likewise, the light blocking area of the coverage zone 404 is greater then the light blocking area of the coverage zone 405. The light blocking area of the coverage zone 405 is greater then the light blocking area of the coverage zone 406. Thus, the light blocking area of subsequent coverage zones, starting from the shield center 105 decrease along the path 106*a*. Likewise, the light blocking area of subsequent coverage zones, starting at the shield center 105, decreases along the path 106*b*.

As can be appreciated, the width of the coverage zones decreases as the number of coverage zones increases. In an alternative embodiment, not shown, N coverage zones can be defined. The N coverage zones can be defined as having a width that approaches zero (i.e. for N coverage zones, the width is proportional to 1/N, thus as N becomes very large the width approaches zero). In an exemplary embodiment with the coverage zones defined as having a width approaching zero, the decrease in the light blocking area of the plurality of coverage zones is linear along the path 106*a* from the shield center 105 to the outer edge 104*a*.

Regardless of the number of coverage zones, and the corresponding width of the coverage zones, the light blocking area of the coverage zone closest to the center 105 is preferably not 100 percent. Thus, a portion of the light emitted from the light source 110 can be permitted to pass through the light shield 100 along the 180 degree axis 112. As depicted in FIG. 8, the light blocking area at the center 105 of the light shield 100 is 70 percent.

The present invention has been described in terms of preferred and exemplary embodiments thereof. Numerous other embodiments, modifications and variations within the scope and spirit of the appended claims will occur to persons of ordinary skill in the art from a review of this disclosure.

I claim:

1. A lighting apparatus, comprising:

a light source mounted within a light fixture; and a light shield mounted to the fixture, the light shield comprising a center, a first side having a first outer edge, a first path and a first plurality of coverage zones, and a second side having a second outer edge, a second path and second a plurality of coverage zones, wherein each coverage zone has a light blocking area corresponding to an amount of light blocked from the light source, wherein the first plurality of coverage zones extend from the center to the first outer edges along the first path and the second plurality of coverage zones extend from the center to the second outer edge along a second path, wherein the plurality of light blocking areas on the first side gradually decreasingly block light along the first path and the plurality of light blockings areas on the second side gradually decreasingly block light along the second path.

2. The fixture of claim 1, wherein the decrease in the light blocking area is linear along the first and second paths.

3. The fixture of claim 1, wherein the light shield has a generally saw-tooth pattern on the first side and the second side.

4. The fixture of claim 1, wherein the light source is a T-5 lamp.

5. The fixture of claim 1, wherein the light shield comprises an inner aperture on the first side

6. The fixture of claim 5, wherein the inner aperture has a truncated diamond shape.

7. The fixture of claim 5, wherein the inner aperture includes a first edge, a second edge, a third edge, a fourth edge, and a fifth edge.

8. The fixture of claim 5, wherein the inner aperture includes a first edge and a second edge, the edges configured to decrease, along the first path, the amount of light blocked by the plurality of the light blocking areas.

9. The fixture of claim 5, wherein the inner aperture comprises a first edge and a second edge, wherein the first edge is configured to decrease, along the first path, the amount of light blocked by the plurality of the light blocking areas, and the second edge is configured to increase, along the first path, the amount of light blocked by the plurality of the light blocking areas.

10. The fixture of claim 5, wherein the inner aperture includes an edge, the edge including a first slope and a second slope, the first slope configured to decrease, along the first path, the amount of light blocked by the plurality of the light blocking areas, and the second slope configured to increase, along the first path, the amount of light blocked by the plurality of the light blocking areas.

11. The fixture of claim 5, further comprising an outer aperture, wherein the inner and outer aperture are configured to decrease, along the paths, the amount of light blocked by the plurality of the light blocking areas.

12. The fixture of claim 5, wherein the light shield further comprises an outer aperture, a first point located on the center, a second point on the light shield located some distance from the center, a third point on the light shield located between the second point and the outer edge, and a fourth point located on the outer edge of the light shield, wherein the inner aperture is configured to decrease, along the paths, the amount of light blocked by the plurality of the light blocking areas between the first and second point, the inner aperture is configured to increase, along the paths, the amount of light blocked by the plurality of the light blocking areas between the second and third point, and the outer aperture is configured to decrease, along the paths, the amount of light blocked by the plurality of the light blocking areas between the second and third point at a first rate and the outer aperture is configured to decrease, along the paths, the amount of light blocked by the plurality of the light blocking areas between the third and fourth point at a second rate.

13. The fixture of claim 12, wherein the inner aperture and the outer aperture provide a linear decrease, along the paths, of the amount of light blocked by the plurality of the light blocking areas.

14. The fixture of claim 1, wherein the light shield comprises an outer aperture.

15. The fixture of claim 14, wherein the outer aperture comprises a first edge and a second edge, the first and second edge being configured so as to decrease, along the path, the amount of light blocked by the plurality of the light blocking areas.

16. The fixture of claim 14, wherein the outer aperture comprises a first edge, a second edge, a third edge and a fourth edge.

17. The fixture of claim 14, wherein the outer aperture comprises a generally saw-tooth pattern.

18. The fixture of claim 14, wherein the light shield includes opposing first end and second ends, the ends defining a length, an opposing first side and second side, and the outer aperture comprises a plurality of sections repeated along the length of the light shield on the first side and the second side, and the lengthwise position of the sections on the first side is not symmetric about the center of the light shield with the lengthwise position of the sections on the second side.

19. A lighting apparatus, comprising:

a light source mounted within a light fixture; and a light shield mounted to the fixture, the light shield comprising a center, a first side having a first outer edge, a first path and a first plurality of coverage zones, and a second side having a second outer edge, a second path and second a plurality of coverage zones, wherein each coverage zone has a light blocking area corresponding to an amount of light blocked from the light source wherein measurable coverage area at the center is less then 90 percent, wherein the first plurality of coverage zones extend from the center to the first outer edges along the first path and the second plurality of coverage zones extend from the center to the second outer edge along a second path, wherein the plurality of light blocking areas on the first side decreasingly block light along the first path and the plurality of light blockings areas on the second side decreasingly block light along the second path.

20. A lighting apparatus, comprising:

a light source mounted within a light fixture, the light source having a longitudinal axis and a 180 degree axis;

a light shield mounted to the fixture, the light shield comprising, an outer edge and a center, the center being located on the 180 degree axis and being parallel to the longitudinal axis, wherein a percentage of light from the light source can pass through the light shield at the center; and a zone boundary located on the light shield between the center and the outer edge, wherein a first coverage zone is located between the center and the zone boundary and a second coverage zone is located between the zone boundary and the outer edge, wherein a light blocking area of the first coverage zone is greater than a light blocking area of the second coverage zone.

21. The lighting apparatus of claim 20, further comprising a plurality of coverage zones, such that the width of each coverage zone approaches zero, wherein the change in the light blocking area between adjacent coverage zones is linear.

22. The lighting apparatus of claim 21, further comprising a path from the center to the outer edge, wherein there is a linear change in the light blocking area of the plurality of coverage zones along the path.

* * * * *